United States Patent [19]

Ilich

[11] 4,343,135

[45] * Aug. 10, 1982

[54] SUPPORT FRAME AND METHOD OF MAKING AND PACKAGING THE SAME

[76] Inventor: Daniel F. Ilich, 149-44 Cherry Ave., Flushing, N.Y. 11255

[ * ] Notice: The portion of the term of this patent subsequent to Apr. 21, 1998, has been disclaimed.

[21] Appl. No.: 63,055

[22] Filed: Aug. 2, 1979

Related U.S. Application Data

[63] Continuation-in-part of Ser. No. 924,984, Jul. 17, 1978, Pat. No. 4,262,810.

[51] Int. Cl.[3] ..... B65B 19/00

[52] U.S. Cl. ..... 53/444; 53/445; 53/474

[58] Field of Search ..... 206/321, 578; 312/184; 211/189, 162, 46, 206, 182; 29/509, 155 R, 155 C; 403/231, 234, 401, 402; 53/396, 397, 399

[56] References Cited

U.S. PATENT DOCUMENTS

| | | | |
|---|---|---|---|
| 2,106,602 | 1/1938 | Hunter | 29/155 C |
| 3,025,955 | 3/1962 | Caldwell et al. | 206/321 X |
| 3,168,917 | 2/1965 | Bartels | 29/509 |
| 3,266,496 | 8/1966 | West et al. | 211/162 X |
| 3,805,966 | 4/1974 | Wakeman et al. | 211/182 |
| 3,853,227 | 12/1974 | Filipowski | 211/162 |
| 3,999,663 | 12/1976 | Walter et al. | 211/189 X |
| 4,132,178 | 1/1979 | Mueller et al. | 403/234 X |

FOREIGN PATENT DOCUMENTS

| | | | |
|---|---|---|---|
| 208227 | 5/1957 | Australia | 312/184 |

*Primary Examiner*—Roy D. Frazier
*Assistant Examiner*—Robert W. Gibson, Jr.
*Attorney, Agent, or Firm*—Arthur T. Fattibene

[57] ABSTRACT

A support frame and method of making and packaging such frame which comprises a pair of similarly constructed end supports formed of readily bendable structural members, each having a specifically constructed notch configuration about which the structural members can be readily bent to define an inverted U-shaped end support. The arrangement is such that the ends of side rails for maintaining opposed end supports in predetermined spaced relationship are disposed within the respective notches whereby the notches closed about the end of a corresponding side rail to positively secure the rails to the end support during the bending and forming of the U-shaped end support. The structural members and side rails defining the complete support frame are packaged as elongated rectilinear members in complementary pairs with the side rails packaged between a pair of elongated unbent end support members so as to occupy a minimum of space for shipping or packing. Cross pieces are also provided for interconnecting the opposed leg portion of a formed end support, and which cross pieces can be readily nested between the elongated complementary end forming structural members in the packaged position.

2 Claims, 22 Drawing Figures

FIG. 14
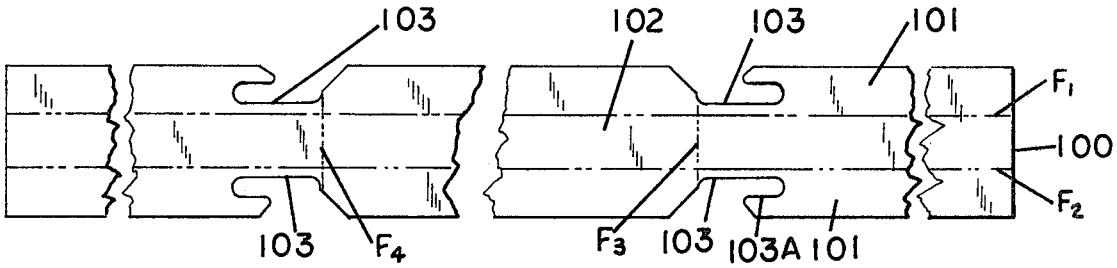
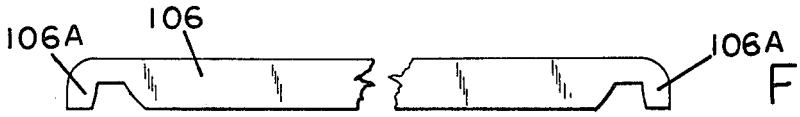
FIG. 20
FIG. 15
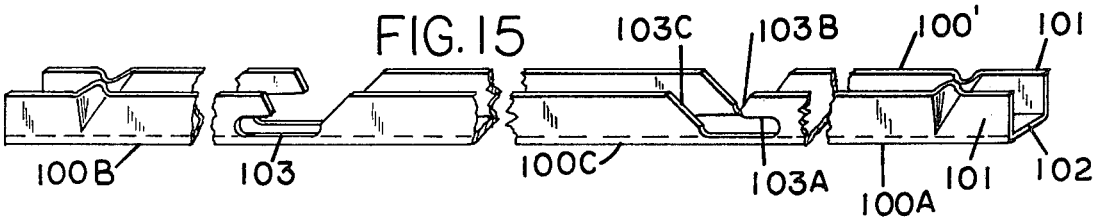
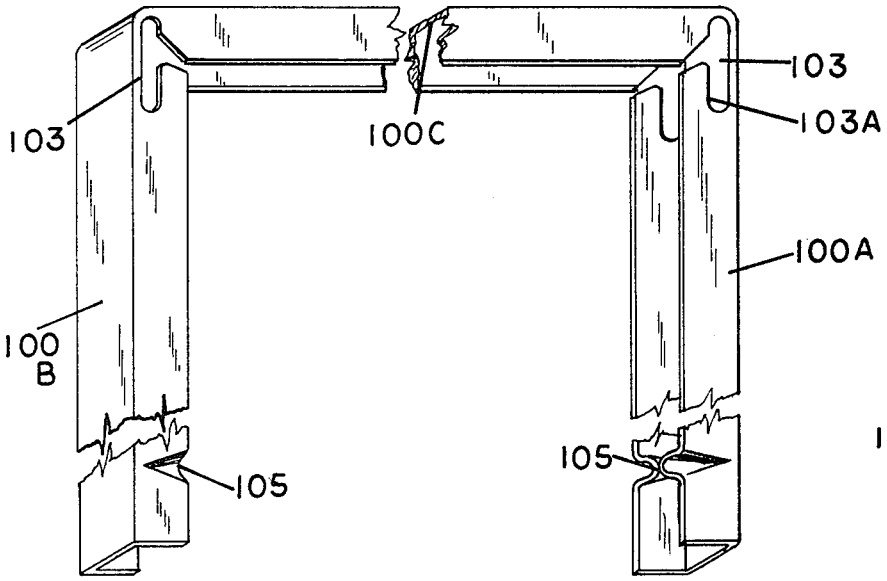
FIG. 16
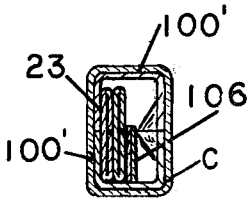
FIG. 19
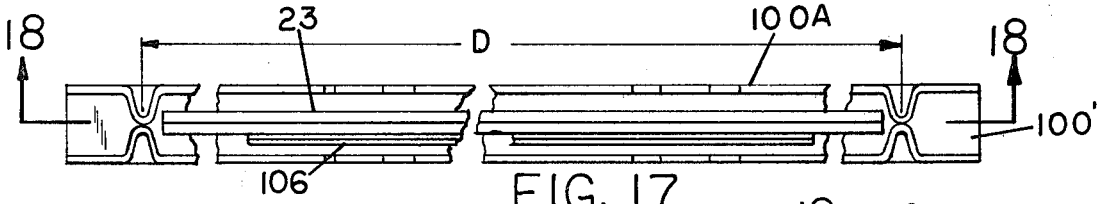
FIG. 17
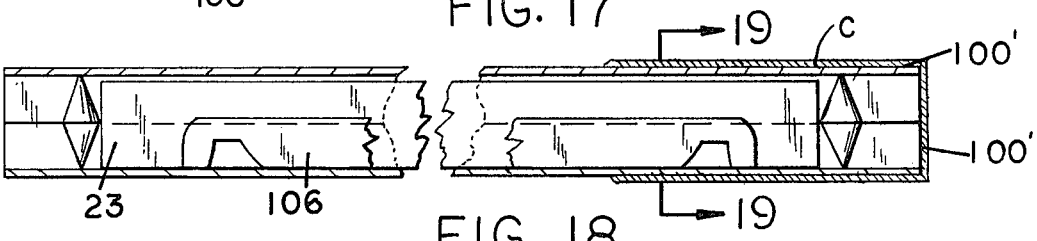
FIG. 18

SUPPORT FRAME AND METHOD OF MAKING AND PACKAGING THE SAME

RELATED APPLICATIONS

This application is a continuation-in-part application of my co-pending application Ser. No. 924,984, filed July 17, 1978, now U.S. Pat. No. 4,262,810 for Frame Structure and Method of Making Same.

PRIOR ART STRUCTURES

Heretofore, there have been numerous known efforts to provide a supporting frame which can be readily assembled. However, each of the known effects had inherent disadvantages. Some of the known efforts require the need and use of various hand tools to effect the assembly. Others require the need of various types of fastening devices to secure the respective component parts in the assembled position. Others required the use of preformed structural components which increased the manufacturing cost of such supporting frames, and/or which were difficult to pack and/or store. Others were relatively complicated and costly to manufacture and/or assemble. Still others were not rendered readily adjustable and could be made only in predetermined sizes over which the ultimate users could not adjust or vary, if so desired. The following cited U.S. patent specifications comprise the known patented art pertaining to supporting frames to which the instant invention relates: U.S. Pat. Nos. 2,336,802; 3,208,456; 3,266,496; 3,684,340; 3,788,718; 3,860,119; 3,913,995; 3,999,663; and 4,030,610;

Also it was noted that the commercially known support frame, particularly those used for hanging files included prefabricated end supports which were sufficiently wide so as to accommodate transversely either letter size files or legal size files. For this reason, such prefabricated support frame occupied a relatively large surface area which required relatively large packing boxes or cartons, which were not only relatively costly, but also occupied a considerable amount of storage and/or shipping space. Thus, the inherent construction of those prior known, prefabricated support frames which were factory formed as U-shaped end members, because of additional packaging, storing, and shipping costs, presented a relatively costly end product.

OBJECTS

An object of this invention is to provide an improved supporting frame structure which can be readily assembled of relatively simple structural members and which can be assembled without the need of any hand tools.

Another object is to provide a supporting frame which can be rendered adjustable in size so as to suit the needs of the ultimate user.

Another object is to provide a supporting frame and method of forming the same from relatively inexpensive structural members which when assembled forms a sturdy supporting frame structure.

Another object is to provide a supporting frame structure which requires no extraneous fastening devices to maintain the component parts in the assembled position.

Another object is to provide a frame support which can be readily shipped and/or compactly stored as simple elongated structural members which can be readily formed and assembled by the ultimate user.

Another object is to provide a novel method for packaging and assemblying structurally formed frame members which in an assembled position defines a support frame.

SUMMARY OF INVENTION

The foregoing objects and other features of the invention are attained by a supporting frame and method for constructing the same which comprises component members which are formed of a plurality of essentially elongated or rectilinear structural members. At least a pair of such members are formed of readily bendable structural material. The bendable members are each formed with a particular notch construction, a pair of such notches being formed intermediate the length of its respective member. The notches are so formed and located so that the bending of the structural members is facilitated to define an inverted U-shaped end support; and when in the bent position, the notch defines a retainer for supporting the ends of the side rails for maintaining the opposed bent end supports in a rigid assembly. A cross piece is detachably connected between the opposed bent ends of the structural members for added rigidity. The respective side rails are formed with frangible portions at spaced intervals so that the ultimate user can determine the length of a particular assembled frame support.

The method of fabricating such frame support comprises the step of forming at least a pair of structural members which can be readily bent about a notch which is so formed that in the bent position, it defines an end support for the side rails. The method thus defines an expedient and economical manner for assembling a support frame without the need of any hand tool or extraneous fastening devices.

The component parts in accordance with this invention are such that they can be neatly and compactly packaged so as to occupy a minimum of shipping and/or storage space when in the unassembled form. This is attained by pairing two elongated complementary members from which the end U-shaped supports are formed in contiguous relationship whereby the side rails and cross pieces for a given frame are longitudinally disposed between or adjacent the elongated end forming member.

BRIEF DESCRIPTION OF THE DRAWINGS

FIG. 14 is a plan view of an expanded blank from which the elongated end member is formed as a modified embodiment.

FIG. 15 is a perspective view illustrating the blank of FIG. 14 in its elongated extended form.

FIG. 16 illustrates a perspective view of the elongated member of FIG. 15 bent to define an end support frame, with the side rails removed.

FIG. 17 is a detail plan view showing the component parts nested in a compact shipping position.

FIG. 18 is a section view of the nested position of the component parts in the packaged position, taken along line 18—18 on FIG. 17.

FIG. 19 is a section view taken on line 19—19 on FIG. 18.

FIG. 20 is a side view of a cross piece.

DETAILED SPECIFICATION

Figure 1:
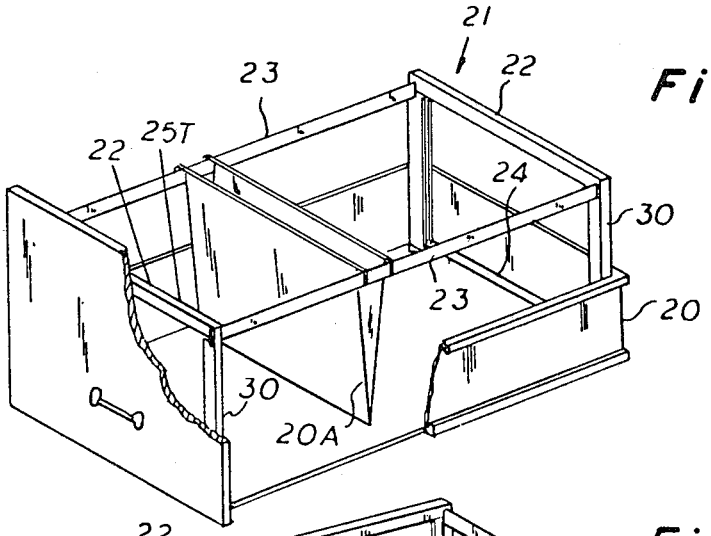
FIG. 1 is a perspective view illustrating the support frame utilized as a hanging file frame in a file drawer.
Figure 4:
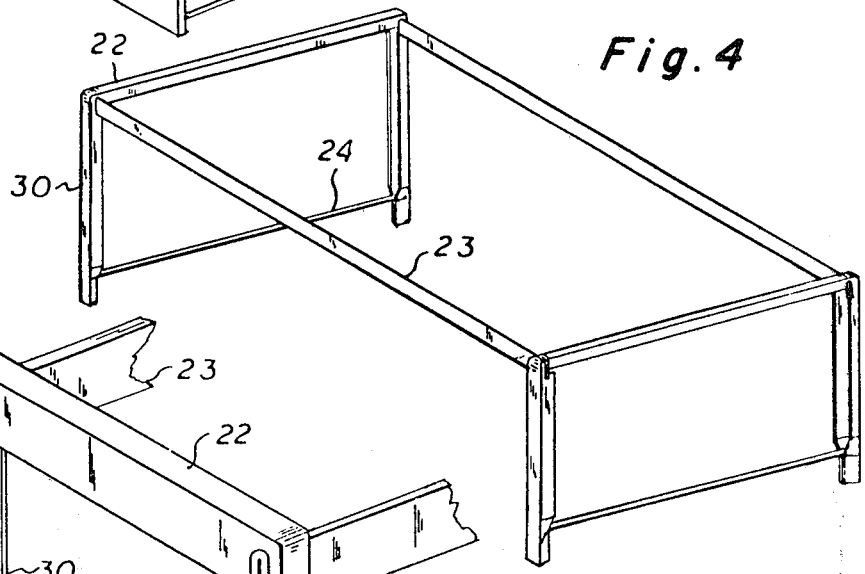
FIG. 4 is a perspective view of a support frame of the present invention in an assembled position.

Referring to the drawings, there are illustrated several embodiments of the invention. Each embodiment as is generally disclosed in FIG. 1 embodies the concept of support frame 21 which is defined by a pair of end supports 22—22 interconnected by a pair of side rails 23—23 which; as will be hereinafter described are frictionally secured in specially constructed notches formed at the bends which define the end U-shaped supports 22. Cross piece may be interconnected between the opposed leg portions of an end support 22. As shown in FIG. 1, the support frame is illustrated for use in a file drawer 20 for use as a support frame for hanging files. However, it will be understood that the support frame is capable of other uses, and may function as a base support for such items as a table, platform, scaffling, and various other items of furniture or the like.

Referring specifically to FIGS. 14 to 22, there is shown a support frame 22A, which is only fragmentarily shown, it being understood that it comprises a pair of end supports similarly constructed and interconnected in spacial relationship by a pair of side rails 23 as will be hereinafter described.

As shown in FIG. 14, the end support of the frame 22A is fabricated from a blank 100 of readily bendable material such as metal or other suitable structural material. The blank 100 comprises a longitudinally extending strip which is folded about a pair of longitudinally extending foldlines $F_1$ and $F_2$ to define a U-shaped channel member 100′ as best seen in FIG. 15. In the formed position of FIG. 15, the channel member 100′ includes a pair of side web portions 101 and an interconnecting web portion 102. Intermediate, the ends of the channel member, the side web portions 101 are each provided with a pair of spaced apart notches 103—103. The notches 103—103 in the opposed side web portions are disposed in alignment.

As best seen in FIGS. 14 and 15, each notch 103 includes a return end portion 103A which is adapted in the assembled position to define a seat for embracing or circumscribing a substantial peripherial portion of a side rail 23. The respective notches 103 each open to a longitudinal edge of its side web portion 101, and which notch opening is defined by outwardly tapered side edges 103*b* and 103*c*. The arrangement is such that when the elongated channel member as shown in FIG. 15 is bent to define the end support 22A, the tapered edge 103*b* and 103*c* tend to close the notch opening; and permit the bent portion to be disposed generally normal relative to the adjacent portion. As best seen in FIG. 15, the edge 103*c* tapers outwardly from the looped end of the notch 103 adjacent to the interconnecting web 102.

Accordingly, as noted in FIG. 16, when the opposed end portions 100A–100B are bent relative to the center portion 100C a generally U-shaped end support is formed wherein the fold line or bend will normally occur about a fold area generally indicated at $F_3$ and $F_4$.

Figure 12:
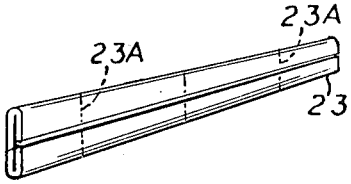
FIG. 12 is a detail view of a side rail.
Figure 21:
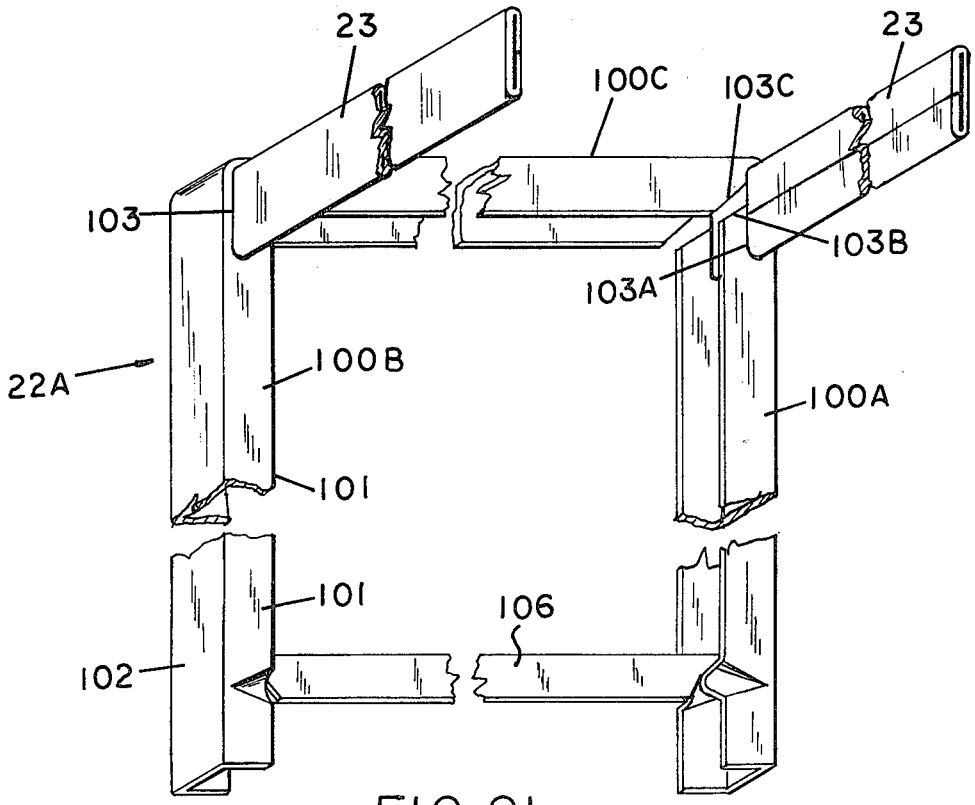
FIG. 21 is a perspective view showing the end support in an intermediate assembled form.

The side rails 23, as seen in FIG. 21 comprise an elongated bar or stock material which may be formed of the same stock material the end support is formed. When relatively thin gauge sheet material is used, the side rails 23 may be formed by reversely bending the opposed ends of a width of material as best seen in FIG. 21. Thus a flat and tight C shape folded side rail is formed. If desired, the side rails may be formed with a series of transversely extending frangible lines spaced along the end portions thereof to render the length of the side rails readily adjustable; as noted with reference to FIG. 12.

The end support adjacent to the lower end of bent portions 100A and 100B have their respective side web portions 101—101 inwardly pinched or crimped as indicated at 105. The inwardly pinch or bent portions of side webs 101,101 provides a means for retaining a cross piece 106 between the opposed bent portions 100A and 100B which define the leg portions for the support frame 22A.

As best seen in FIG. 20, the cross piece 106 comprises a piece of flat stock material having hook shaped end portions 106A which are adapted to be hooked in behind the pinched or crimped portions 105 of the side webs 101. The arrangement is such that the cross piece 106 will prevent spreading or maintain the leg portions 100A and 100B fixed relative to each other.

To assemble the frame structure, reference is made to FIG. 21. As shown herein the end portion of the side rail 23 is placed in the notch 103 before the end portion of the channel member is bent. With the end of the side rail 23 in place in notch 103, the extended end of the channel member is bent which causes the rail member to be rotated therewith and to be securely locked and wedged in the notch 103 as the edges 103*b* and 103*c* close toward one another. When the side rails are secured at one end to the end support member, the other end support member is similarly secured to the other end of the side rails. To maintain the leg portions 100A and 100B of the respective end support members spaced apart, a cross piece 106 is disposed therebetween by hooking or latching the hook end portions 106A. thereof onto the crimped portion 105 of the leg portions 100A and 100B.

From the described construction a rigid support frame is readily formed without the use of any tools and can thus be fabricated by an ultimate user.

The specific construction of the elongated end support member as shown in FIG. 15, the side rails 23—23, and the cross-pieces 106 are further constructed so as to facilitate the packaging, shipping and storing of the respective component parts. As seen in FIGS. 17, 18 and 19 the component parts sufficient to construct one complete support frame which includes two elongated end members, two side rails 22–23 and two cross pieces 106—106 can be compactly packaged within a plastic overwrap or in a box or suitable container C so as to occupy a minimum of space by positioning the two elongated members in face to face relationship as best seen in FIGS. 18 and 19. The width between the opposed side web portions 101,101 is sufficient to receive the pair of side rails 23—23 and the pair of cross pieces 106—106. It is to be further noted that the distance "D" between the crimp portion 105 is sufficient to accommodate a standard file drawer length side rail 23. With the component parts nested as seen in FIGS. 17, 18, and 19, the components of the support frame can be readily releasably secured in a package or container C as to be stored, shipped, and/or merchandised in a manner so as to occupy a minimum of space. Also, the component parts as described can be readily assembled by the ultimate consumer in a very simple and expedient manner.

As shown, in FIG. 1, the frame 21 is in its assembled form and is utilized to support a plurality of hanging file folders 20A within the file drawer. The frame 21 is formed essentially of a pair of opposed end supports 22—22, a pair of side rails 23—23, and a pair of cross pieces 24—24. Essentially, the end supports 22—22, side rails 23—23 and cross pieces 24—24 are formed of elongated structural members which are intended to be shipped and stored as elongated components in kit form as herein described to that they can be readily assembled by the ultimate consumer or user with the need of no tools or extraneous fastening devices.

Figure 5:
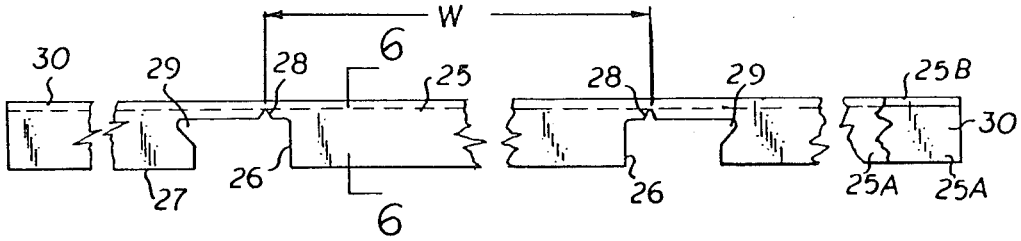
FIG. 5 is a detail side view of a component part forming the end support prior to assembly.

In another embodiment, as best seen in FIG. 5, the end support is initially also fabricated as an elongated structural member 25 which is formed of a readily bendable material such as thin stock metal or plastic. In the illustrated embodiment, member 25 is formed from a channel shaped member having opposed side web portions 25A,25A and an interconnecting web portion 25B. According to this invention, the respective side web portions 25A,25A are each formed with a generally U-shaped notch 26, the notches in the respective web portions 25A,25A being in alignment. The notches 26,26 are spaced apart intermediate the length of the respective members 25.

Figure 6:
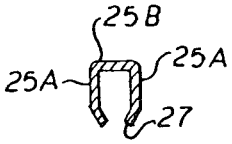
FIG. 6 is a section view taken along line 6—6 on FIG. 5.
Figure 7:
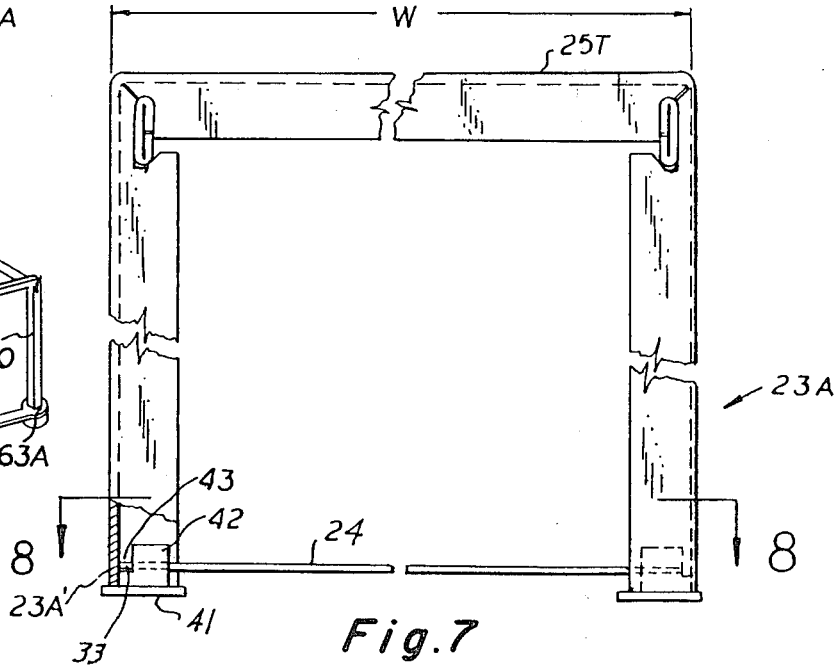
FIG. 7 is an end view of a modified support frame.

As best seen in FIG. 5, the notches 26 open to the free edge portion 27 of the respective side web portions 25A,25A Also, the free edges 27 of the channel member may be slightly, inwardly turned, as best seen in FIG. 6 for added strength. Along the back edge of the respective notches 26, there is a V-notch or groove 28. The V-groove defines a weakened portion about which the member 25 may be bent, as indicated in FIG. 1 or FIG. 7. The end of the notch 26 nearest the free end of the member 25 is provided with a lateral notch portion 29, which as will be hereinafter described, defines a seat for the side rail 23, in the assembled position. The arrangement is such that the interval between V-grooves 28—28 defines the width W of the end support 23. The extended end portions of the member beyond the notches 26 defines in the assembled position the leg portions 30 of the frame 21. Thus when member 25 is formed as herein described, it defines an inverted U-shaped end support 22.

The side rails 23 may be formed of a rigid stock material of a prescribed length. If desired, the side rails 23 may be provided with a series of scored lines or frangible points 23A whereby the user can adjust the side rail to a desired length by fracturing the side rail along a given frangible point 23A to establish the desired length. It will be understood that the frangible points 23A are so formed so as to facilitate the fracturing of the side rail transversely thereof, without effecting the longitudinal rigidity of the member 23. In the illustrated embodiment, the side rail is shown as a member having its opposed end portions reversely bent to define an essentially double walled member. However, it will be understood that a bar stock may also be used to form the side rail 23.

Figure 2:
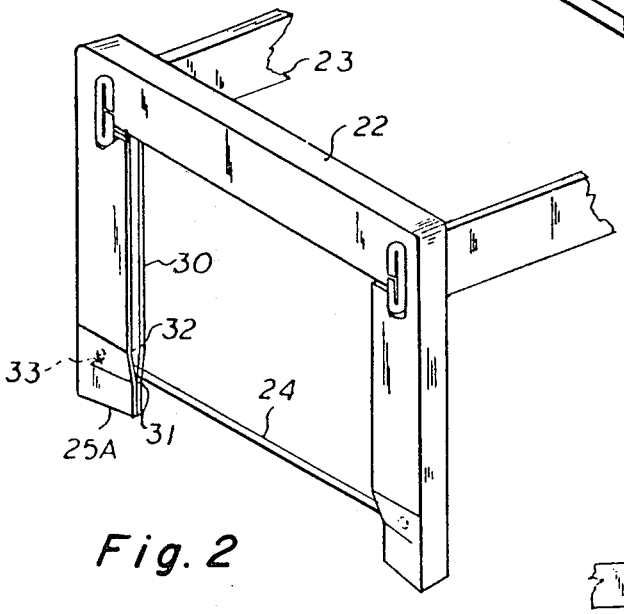
FIG. 2 is a perspective view of a detail of construction.
Figure 3:
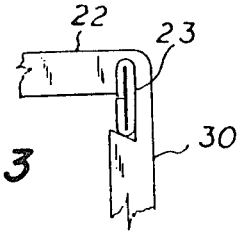
FIG. 3 is an end view of a corner construction.

Referring to FIGS. 2 and 7, it will be noted that member 25 is so formed that the leg portions are bent relative to the intermediate portion 25 between V-grooves 28,28. In doing so, the edges of the notches 26 are formed about the end portions of the side rails so as to define a seat for snugly securing the end portions of the respective side rails 23 between the top portion 25T and the adjacent leg portion 30. In this manner, the side rails 23 function to securely connect the opposed end supports 22—22 in desired spaced relationship without the need of tools or extraneous fastening means. Thus, the notch 26 is so formed that upon the bending of member 25 as described, the side rails are securely fastened to the opposed end supports 22—22.

To prevent the leg portions from spreading apart under load, a cross piece 24 is interconnected between corresponding leg portions 30—30 of the end supports 22. In this form of the invention shown in FIG. 2, the lower leg portions are formed by inwardly pressing the side web portions 25A,25A toward one another to define a pressed foot portion 31. In doing so, a V-shaped slot 32 is formed between web portions 25A,25A. The cross-piece 24 is defined by a wire or rod having a cross head or pin 33 connected at its ends and which is received and secured in the V-slot 32 of the opposed foot portion 31.

With the frame 21 assembled as described, it can be readily placed in drawer 20 and used as a frame for hanging file folders 20A. In the construction described, it will be noted that the upper edges of the rails 23,23 are smooth so that the files 20A may easily slide along the surface of rails 23.

Figure 8:
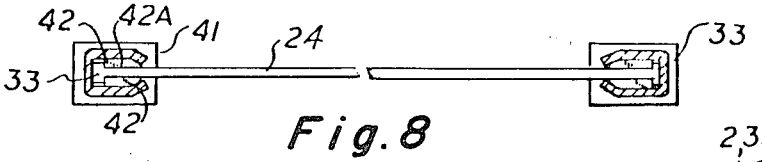
FIG. 8 is a section view taken along line 8—8 on FIG. 7.

FIG. 7 illustrates a modified frame structure 40. In this form of the invention, the structural member is channel shaped as hereinbefore described, and is different in that the foot portions are not inwardly pressed as described with respect to FIG. 2. In this form of the invention, as seen in FIG. 7, the end supports 23A are provided with a foot 41 which has a boss or projection 42 which is adapted to be snugly received in the lower end of the opposed leg portions. As best seen in FIGS. 7 and 8, the projection has a surface portion which is spaced from the interconnecting web portion 23A' to define a recess or slot 43. In this form of the invention, the cross head 33 of the cross piece 24 is received in slot 43, the projection 42 having a transverse slot 42A for accommodating the wire cross piece 24. In all other respects the frame 23A is similar to that described in FIGS. 1 and 2.

Figure 9:
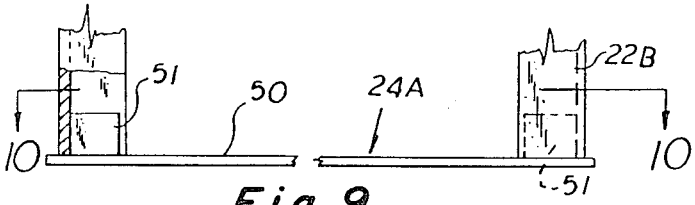
FIG. 9 is a fragmentary end view of a modified constructional detail.
Figure 10:
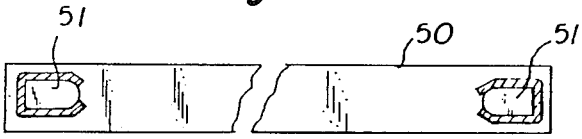
FIG. 10 is a sectional plan view taken along line 10—10 on FIG. 9.

FIGS. 9 and 10 illustrate another modified construction. In this form of the invention the end support 22B is identical to that described with respect to end support of FIG. 7. However, in this form of the invention, the cross piece 24A has been modified. As shown in FIGS. 9 and 10, the cross piece 24A comprises a strap 50 having connected adjacent the ends thereof a boss or projection 51 which is adapted to be frictionally received in the end of the respective leg portions of the end support. Thus the strap 50 defines the base upon which the end supports are seated in a file drawer when used as a hanging file support.

Figure 11:
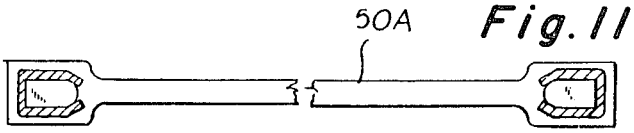
FIG. 11 is a plan view of another modified construction.
Figure 22:
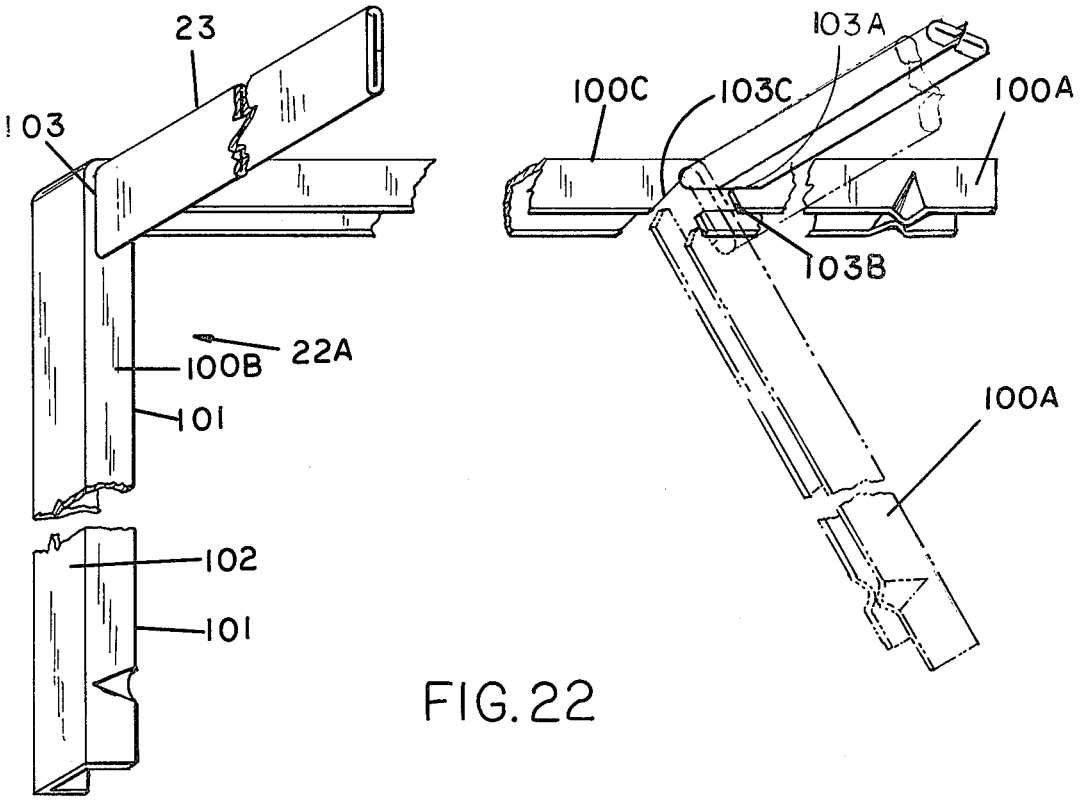
FIG. 22 is a perspective view of an end support member showing the side rails fixed thereto.

The embodiment of FIG. 11 is similar to that of FIGS. 9 and 10, except that the strap 50A is formed of a reduced width.

Figure 13:
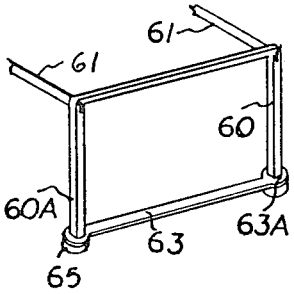
FIG. 13 is a partial perspective view of another modified embodiment.

FIG. 13 illustrates a further embodiment. In this form of the invention, the end supports 60—60 and side rails 61—61 are similar to that described with respect to FIG. 7. However, in this form of the invention, the cross piece 63 is defined as a strap having an eye type opening *63a* formed in the end portion thereof arranged to receive the foot portion *60a* of the end supports. A foot piece 65 having a projection is inserted into the end of the respective leg portions to retain the strap 63 on the respective legs. In all other respects the frame of FIG. 13 is similar to that hereinbefore described.

From the foregoing, it will be noted that the frame has particular application for a hanging file, but it may also be utilized for other purposes as hereinbefore set forth.

According to this invention, the method for constructing a support frame including forming a pair of readily bendable structural members with a pair of spaced apart notches intermediate the length thereof where the notch is formed so that the member can be readily bent thereat, and when bent normal to an intermediate portion defines a seat for frictionally securing thereto the end portions of a side rail. A cross piece is then connected between the opposed leg portions of an end support to prohibit the spreading of the leg members under a loaded or stressed condition. The notch is formed so as to be open to one edge of its member, so as to facilitate bending of the end support member and to define a seat which positively secures the side rail in the assembled position.

While the invention has been described with respect to several embodiments thereof, it will be readily appreciated and understood that variations and modifications may be made without departing from the scope or spirit of the invention.

What is claimed is:

1. A method of packaging the components of a support frame comprising a pair of U-shaped end supports interconnected by a pair of opposed side rails comprising the steps of, forming said pair of U shaped end supports as a rectilinear elongated member of an angular cross section having angularly disposed web portions, forming a notch in a web portion of each of said elongated members at spaced apart intervals intermediate to the ends thereof, whereby said elongated members can be readily folded at said notched portions to define U shaped end support, placing said unfolded members in face to face relationship, locating the side rails between said faced to faced elongated members, and releaseably securing said elongated members and side rails disposed therebetween to define a compact unit in the disassembled position of said support frame.

2. The method as defined in claim 1 and including the steps of locating a pair of cross pieces for interconnecting the leg portions of said end supports when in the assembled position between said elongated members in the disassembled position of said support frame.

* * * * *